US010409314B2

(12) United States Patent
Turner et al.

(10) Patent No.: US 10,409,314 B2
(45) Date of Patent: Sep. 10, 2019

(54) INTEGRATED HOUSING FOR COMPONENTS OF A COOKING APPLIANCE

(71) Applicant: General Electric Company, Schenectady, NY (US)

(72) Inventors: Darren Allen Turner, Louisville, KY (US); Frank Jacob Hellwig, East Ridge, TN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 549 days.

(21) Appl. No.: 14/870,174

(22) Filed: Sep. 30, 2015

(65) Prior Publication Data

US 2017/0089588 A1 Mar. 30, 2017

(51) Int. Cl.

| | |
|---|---|
| ***G05G 1/10*** | (2006.01) |
| ***F24C 3/12*** | (2006.01) |
| ***F24C 3/08*** | (2006.01) |

(52) U.S. Cl.

CPC ..... *G05G 1/105* (2013.01); *F24C 3/085* (2013.01); *F24C 3/126* (2013.01)

(58) Field of Classification Search

CPC . G05G 1/105; F24C 3/12; F24C 3/122; F24C 3/124; F24C 3/126

See application file for complete search history.

(56) References Cited

U.S. PATENT DOCUMENTS

| | | | | |
|---|---|---|---|---|
| 6,224,221 | B1 * | 5/2001 | Glienicke | G02B 6/0033 116/286 |
| 6,627,828 | B1 * | 9/2003 | McCartney | F24C 3/124 200/61.86 |
| 8,783,927 | B2 * | 7/2014 | Claprood | F24C 7/082 362/551 |
| 8,979,289 | B2 * | 3/2015 | Camli | F24C 7/082 362/23.09 |
| 2011/0146650 | A1 * | 6/2011 | Karamatic | F24C 3/126 126/42 |

FOREIGN PATENT DOCUMENTS

| | | |
|---|---|---|
| CN | 204063153 | 12/2014 |

* cited by examiner

*Primary Examiner* — David J Laux
(74) *Attorney, Agent, or Firm* — Dority & Manning, P.A.

(57) ABSTRACT

A cooking appliance is provided including a cooking surface, a heating element, a control surface, and a control element positioned on the control surface. The control element is associated with the heating element, which is positioned on the cooking surface. The cooking appliance also includes an integrated housing positioned below the control surface aligned with the control element. The integrated housing encloses both a lighting assembly for providing light to at least one of the control element or the control surface and an electromechanical switch operably coupled to the control element.

20 Claims, 4 Drawing Sheets

INTEGRATED HOUSING FOR COMPONENTS OF A COOKING APPLIANCE

FIELD OF THE INVENTION

The subject matter of the present disclosure relates generally to a housing for certain components of a cooking appliance.

BACKGROUND OF THE INVENTION

Control knobs, or simply knobs, are commonly used on a variety of commercial and residential appliances to control an operating condition of the appliance. Knobs are particularly common on cooking appliances, such as stoves or cooktops. For gas cooktops, or gas ranges, the knobs may be positioned on a control surface of the gas cooktop and mechanically connected to a control valve via a control rod. The control valve may regulate a flow of combustible gas to a respective gas burner of the cooking appliance. Accordingly, the knob may control an amount of heat provided to, e.g., a cooking appliance on the respective gas burner.

At least certain gas cooktops additionally include a plurality of lighting devices positioned below the control surface of the cooktop for providing light to the control surface around a respective knob. Each of the plurality of lighting devices may be mounted around a respective control rod extending between the respective knob and valve.

Gas cooktops typically also include a plurality of switches, each switch attached to a respective control rod extending between a respective knob and valve. Each of the switches are typically mounted below the respective lighting devices and spaced from the respective lighting devices. The switches may provide a spark to a respective gas burner to ignite the combustible fuel provided to such gas burner.

However, such a configuration may occupy a relatively large footprint beneath a surface of the gas cooktop. Accordingly, a gas cooktop having a lighting device, a switch, and a control valve associated with a respective control knob configured in a more space efficient manner would be useful.

BRIEF DESCRIPTION OF THE INVENTION

Aspects and advantages of the invention will be set forth in part in the following description, or may be apparent from the description, or may be learned through practice of the invention.

In one exemplary embodiment of the present disclosure, a cooking appliance is provided. The cooking appliance includes a cooking surface having a heating element, a control surface, and a control element. The control element is positioned on the control surface and is associated with the heating element. The cooking appliance additionally includes an integrated housing positioned below the control surface and aligned with the control element. The integrated housing encloses a lighting assembly for providing light to at least one of the control element or the control surface proximate to the control element, and an electro-mechanical switch operably coupled to the control element.

In another exemplary embodiment of the present disclosure, an integrated housing for a cooking appliance is provided. The integrated housing includes a first housing member and a second housing member. The first and second housing members are attached to one another and define an enclosed area. The enclosed area houses a lighting assembly for providing light to at least one of the control element or a control surface of the cooking appliance proximate to a control element of the cooking appliance. The enclosed area also houses an electro-mechanical switch for operable connection to the control element of the cooking appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
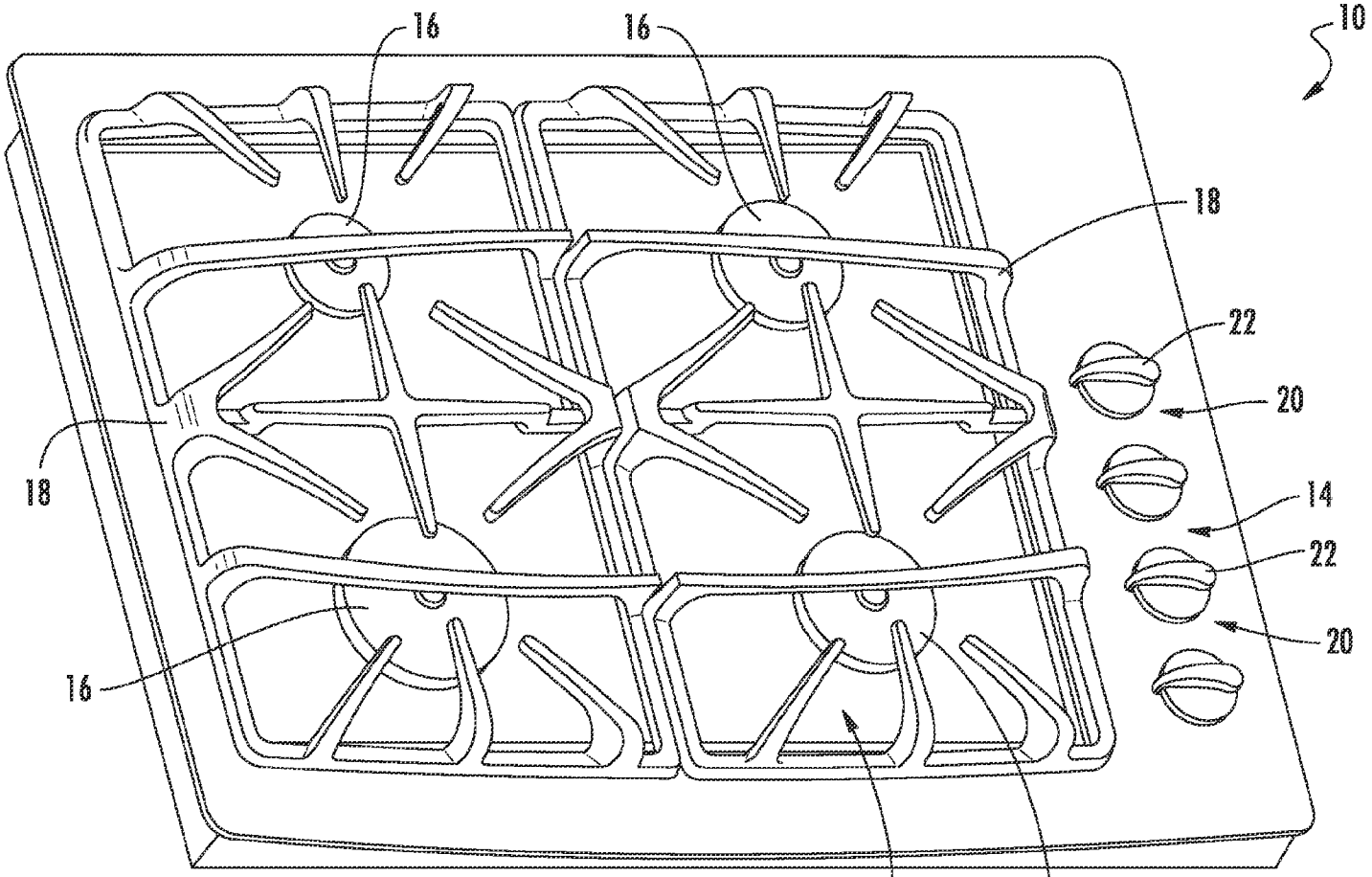
FIG. 1 provides a perspective view of an exemplary embodiment of a cooking appliance of the present disclosure.

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

Referring now to the drawings, FIG. 1 illustrates an exemplary embodiment of a cooking appliance 10 of the present disclosure. Cooking appliance 10 may be, e.g., fitted integrally with a surface of a kitchen counter, or be a part of one or more oven appliances. For example, in certain exemplary embodiments, the cooking appliance 10 may be integrated into a gas range/oven appliance. Cooking appliance 10 may include a chassis (not shown).

Cooking appliance 10 includes a cooktop surface 12 as well as a control surface 14. For the embodiment depicted, control surface 14 and cooktop surface 12 are each formed of separate materials and configured substantially coplanar with one another. More specifically, the control surface 14 and cooktop surface 12, for the embodiment depicted, are each substantially parallel to one another and approximately the same height as one another. However, in other exemplary embodiments, cooktop surface 12 and control surface 14 may instead be formed of a single, continuous material to form a continuous surface. Or alternatively, in still other embodiments, the control surface 14 may be positioned separate from the cooktop surface 12, e.g., on a back control panel of the cooking appliance 10 (not shown) or a front control panel of the cooking appliance 10 (not shown). In one exemplary embodiment, cooktop surface 12 and control surface 14 may each be formed of ceramic glass. In other embodiments, however, one or both of cooktop surface 12 and control surface 14 may be formed of another suitable material, such as a metallic material (e.g., steel) or other suitable non-metallic material.

The cooktop surface 12 of the cooking appliance 10 includes one or more heating elements for use in, e.g., heating or cooking. For the embodiment depicted, each of the heating elements are configured as gas burners 16, and thus the cooking appliance 10 may be referred to as a gas range. The gas burners 16 are configured to ignite a combustible gas into a flame and direct such flame towards, e.g., a cooking utensil to heat the cooking utensil and any food positioned therein. For the embodiment depicted, each of the gas burners 16 includes a metal grate 18 extending thereover to hold, e.g., a cooking utensil a desired distance from the respective gas burner 16.

For the embodiment depicted, the cooktop surface 12 includes four gas burners 16 each having a different size. However, in other exemplary embodiments, the cooktop surface 12 may include any other suitable number of gas burners 16, any other suitable position for the gas burners 16, and/or any other suitable size for the gas burners 16. Moreover, in still other exemplary embodiments, heating elements on cooktop surface 12 may not be gas burners 16, and instead may be any other suitable heating element.

Figure 2:
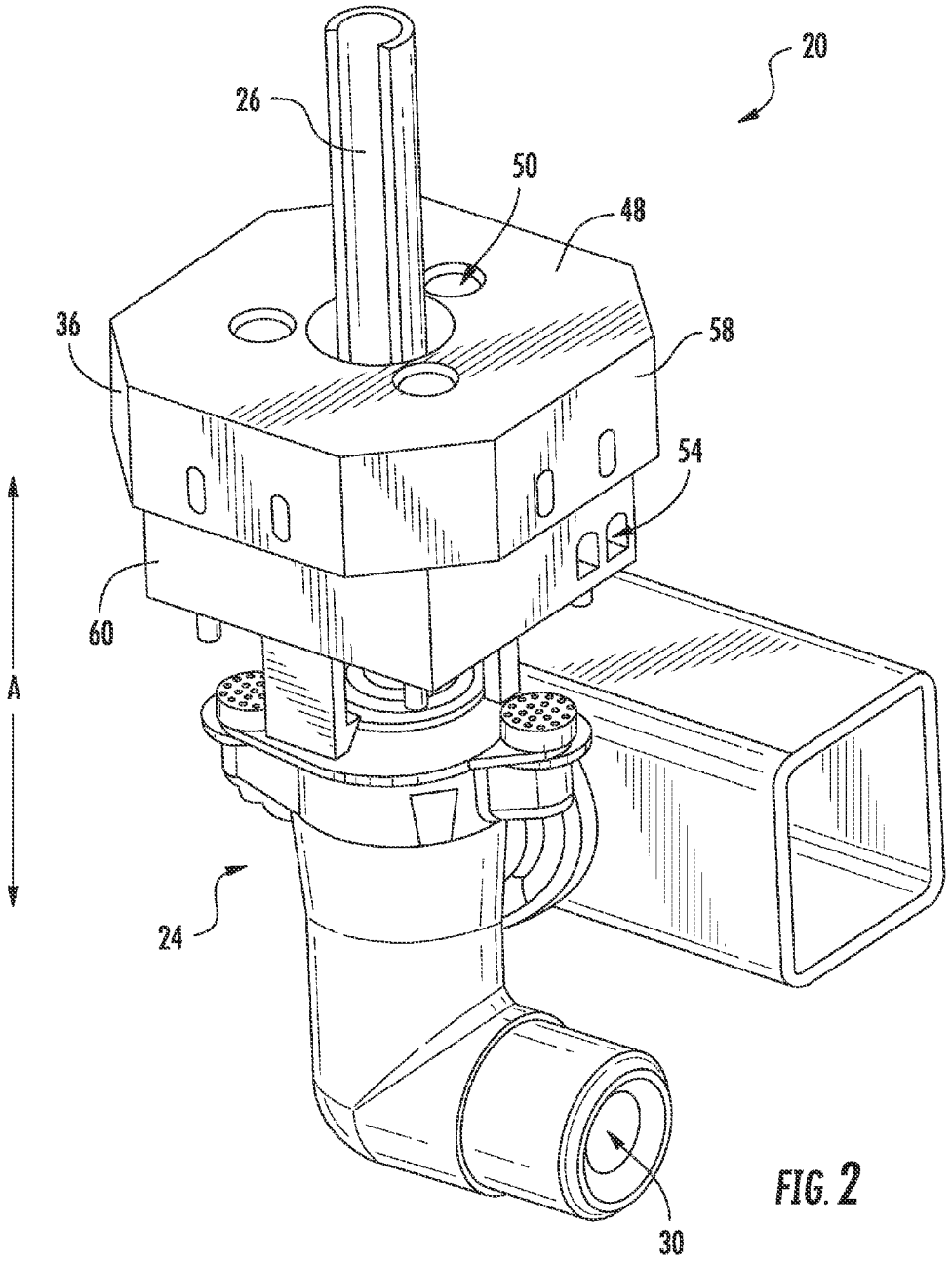
FIG. 2 provides a perspective view of a control assembly in accordance with an exemplary embodiment of the present disclosure.
Figure 3:
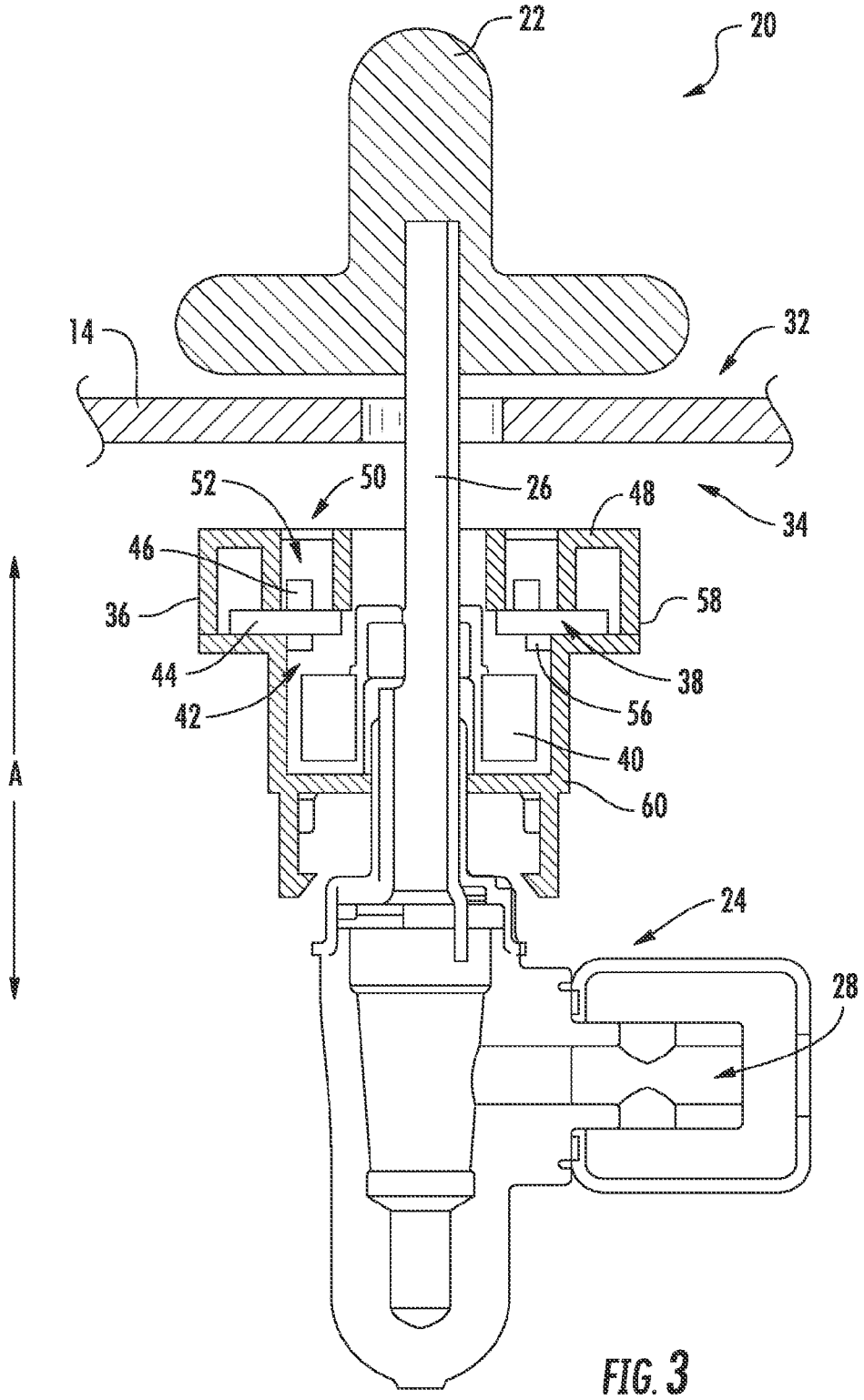
FIG. 3 provides a side, cross-sectional view of the exemplary control assembly depicted in FIG. 2.

The amount of heat delivered by each gas burner 16 on cooktop surface 12 is controlled by a corresponding control assembly 20 (see also FIGS. 2 and 3). For the embodiment depicted, the cooking appliance 10 includes four control assemblies 20, each control assembly 20 associated with a respective gas burner 16. Additionally, each control assembly 20 includes a control element positioned on the control surface 14 and associated with a respective gas burner 16. For the embodiment depicted, each of the control elements are configured as a control knob 22. Control knob 22, as used herein, refers to any configuration of rotary dial, and not just one having a circular base, as shown in FIG. 1. For example, the present disclosure contemplates exemplary embodiments wherein the control knobs 22 have a rectangular base, an ovular base, or any other shape having one or more curved lines, straight lines, or both. Additionally, as discussed in greater detail below, lighting assemblies (not shown) may be positioned below the control surface 14 at or adjacent a bottom portion of knobs 22 in order to illuminate knobs 22 from below.

Referring now to FIGS. 2 and 3, a perspective view and a cross-sectional view, respectively, are provided of a control assembly 20 in accordance with an exemplary embodiment of the present disclosure. The exemplary control assembly 20 of FIGS. 2 and 3 may be incorporated into the cooking appliance 10 described above with reference to FIG. 1. Accordingly, the same or similar numbering may refer to the same or similar parts. Notably, a control element (e.g., a control knob 22) of the exemplary control assembly 20 is removed from FIG. 2 for clarity.

The exemplary control assembly 20 defines an axial direction A and generally includes a control element, which for the embodiment depicted is configured as a control knob 22, a control valve 24, and a control rod 26 extending between the control knob 22 and the control valve 24. The control valve 24 generally includes an inlet 28 (FIG. 3) in flow communication with a fuel source and an outlet 30 (FIG. 2) in flow communication with a heating element, such as a gas burner 16 (see FIG. 1). The control valve 24 is movable between an open position and a closed position, as well as a multitude of positions therebetween, to regulate an amount of fuel provided to the gas burner 16. The control knob 22 is mechanically connected to the control valve 24 via the control rod 26 such that rotation of the control knob 22 actuates the control valve 24 between the open and closed positions, regulating an amount of fuel flow therethrough to the gas burner 16.

As is depicted, the control knob 22 is positioned above the control surface 14 on a first side 32 of the control surface 14 and the control valve 24 is positioned below the control surface 14 on a second side 34 of the control surface 14. Also positioned below the control surface 14 and aligned with the control knob 22 is an integrated housing 36. More specifically, the integrated housing 36 is positioned between the control knob 22 and the control valve 24 at a location below the control surface 14. Moreover, as depicted, the control rod 26 extends through the integrated housing 36.

Referring particularly to FIG. 3, the integrated housing 36 encloses a lighting assembly and an electro-mechanical switch 40. More specifically, the integrated housing 36 defines an enclosed volume 42, with the lighting assembly and the electro-mechanical switch 40 positioned therein.

The lighting assembly is configured to provide light to at least one of the control knob 22 or the control surface 14 proximate the control knob 22 when activated. For the embodiment depicted, the lighting assembly is configured as a light-emitting diode ("LED") lighting assembly 38. The LED lighting assembly 38 generally includes an LED board 44 and a plurality of LEDs 46. As is depicted, a top wall 48 of the integrated housing 36 defines a plurality of openings 50, and for the embodiment depicted channels 52, each with an LED 46 positioned in and/or configured to direct light therethrough.

In certain exemplary embodiments, the control surface 14 may include a transparent, semi-transparent, and/or translucent portion (not shown) in-between and/or proximate to the integrated housing 36 and control knob 22. Additionally, or alternatively, in other exemplary embodiments, the control knob 22 may include a transparent, a semi-transparent, and/or a translucent portion (not shown). With one or more of these exemplary embodiments, light from the LED lighting assembly 38 may signal one or more conditions of the cooktop appliance 10 to a user. For example, in certain exemplary embodiments, the LED lighting assembly 38 may be mechanically or otherwise operably connected to the control rod 26, such that a location or orientation of the control rod 26 initiates a desired operation of the LED lighting assembly 38. For example, the LED lighting assembly 38 may be configured to provide light through at least one of the control surface 14 or control knob 22 when the control valve 24 is providing for a flow of fuel to a respective gas burner 16.

Additionally, in certain exemplary embodiments, the LED lighting assembly 38 may be configured for illuminating in a single color, or alternatively, one or more of the LEDs 46 of the LED lighting assembly 38 may be configured for illuminating in two or more different colors based on certain operating conditions of the gas burner 16, cooking appliance 10, or both. It should be appreciated, however, that in other exemplary embodiments, the lighting assembly may additionally, or alternatively, include any other suitable light source or combination of light sources. For example, the lighting assembly may include another electrical light source, such as one or more traditional light bulbs.

As stated above, the integrated housing 36 additionally encloses the electro-mechanical switch 40. The electromechanical switch 40 is operably, or more specifically, mechanically coupled to the control knob 22 via the control rod 26 and is also operably connected to the gas burner 16. For example, the electro-mechanical switch 40 may be configured to provide one or more sparks to the gas burner 16 to, e.g., ignite a flow of fuel provided to the gas burner 16 in response to the control knob 22 being rotated by a user (which may, in turn, move the control valve 24 to the on position, i.e., to a position in which the control valve 24 is providing a flow of fuel to the gas burner 16).

The integrated housing 36 defines an electrical connection port 54 for attachment to an outside power source. For example, the electrical connection port 54 may be configured to connect the lighting assembly 38 and the electro-mechanical switch 40 to an outside power source, which may be a power source within the cooking appliance 10 or alternatively, e.g., a wall outlet 30 to which the cooking appliance 10 is connected. In at least certain exemplary embodiments, both the lighting assembly 38 and the electro-mechanical switch 40 may be electrically connected to the electrical connection port 54 of the integrated housing 36, such that only a single electrical connection port 54 is necessary to connect both the lighting assembly 38 and the electro-mechanical switch 40 to the power source. Moreover, in certain embodiments, wherein for example the lighting assembly is configured as an LED lighting assembly 38, the LED board 44 of the LED lighting assembly 38 may be mounted to an electrical connector 56 integrally attached to or formed with the integrated housing 36. The electrical connector 56 may, in turn, be electrically connected to the electrical connection port 54, such that the LED lighting assembly 38 is automatically electrically connected to the power source when the LED board 44 is installed and a power source is connected to the electrical connection port 54. Such an exemplary embodiment may allow for easier and quicker installation of both the lighting assembly 38 and the electro-mechanical switch 40.

Figure 4:
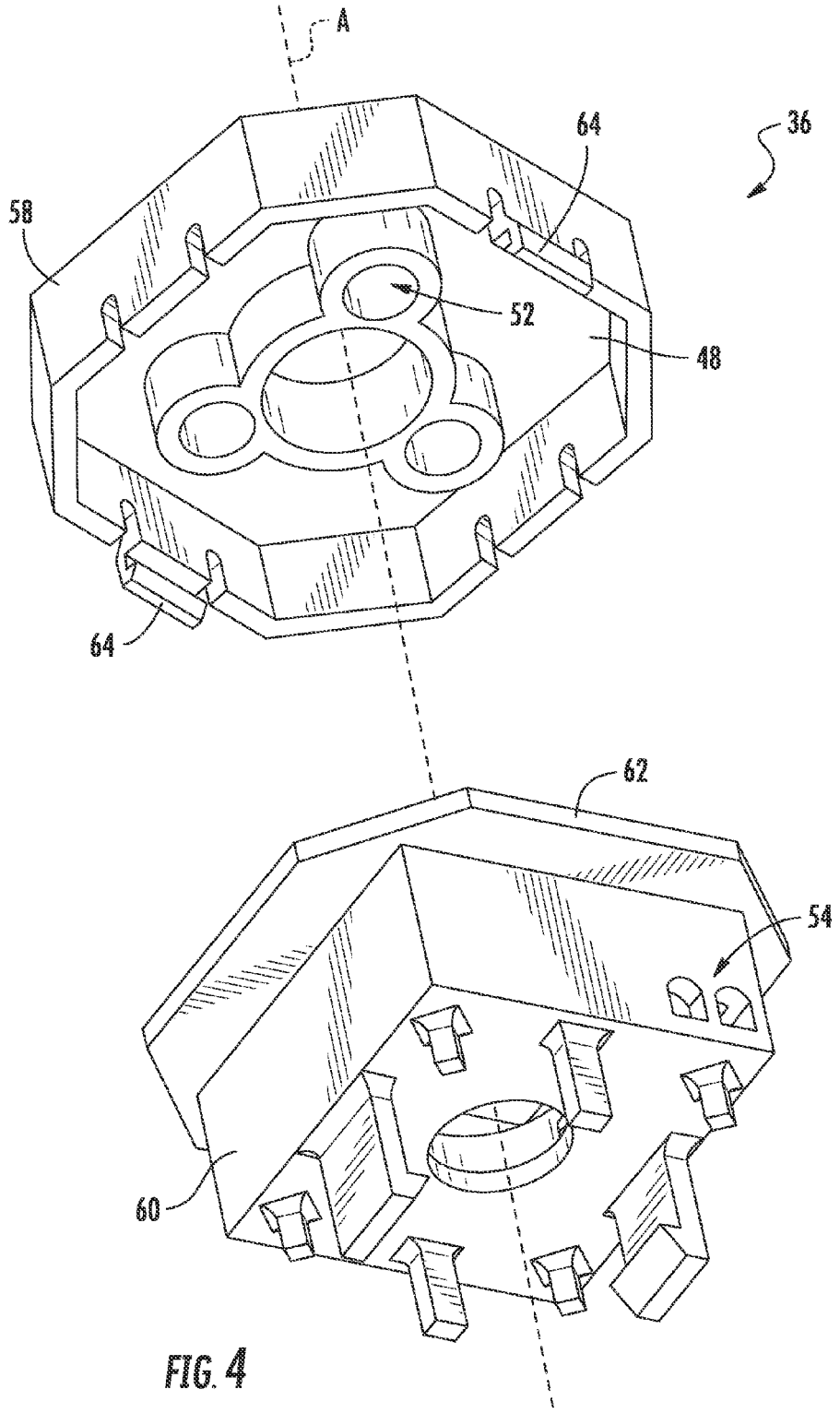
FIG. 4 provides an exploded, perspective view of an integrated housing in accordance with an exemplary embodiment of the present disclosure.

Moreover, referring now also to FIG. 4 a perspective, exploded view of the integrated housing 36 of FIGS. 2 and 3 is provided. As shown, the integrated housing 36 includes a first housing member 58 and a second housing member 60. For the embodiment depicted, the first and second housing members 58, 60 are configured to be releasably attached to one another. Specifically, the second housing member 60 includes a platform 62 on top of which the first housing member 58 is positioned when the first and second housing members 58, 60 are attached. The first housing member 58 includes a pair of snaps 64 configured to lock or snap on to the platform 62 of the second housing member 60 and releasably attach the two components.

It should be appreciated, however, that in other exemplary embodiments, the first and second housing members 58, 60 may instead be releasably attached to one another in any other suitable manner. For example, in other exemplary embodiments, the first housing member 58 may include any other suitable number of snaps for releasably attaching the two components. Additionally, or alternatively, the second housing member 60 may include any suitable number/configuration of snaps for releasably attaching the two components. Alternatively still, the first and second housing members 58, 60 may be attached using one or more suitable screws, bolts, tacks, or other mechanical fasteners. However, in still other embodiments, the two components may not be releasably attached to one another and instead may be permanently attached in any suitable manner. For example, in certain exemplary embodiments the first and second housing members 58, 60 may be permanently attached using a glue or epoxy, welding, etc. Moreover, although the integrated housing 36 is depicted including a first housing member 58 and a second housing member 60, in still other exemplary embodiments, the integrated housing 36 may instead be formed of any other suitable number of housing members. Furthermore, in certain exemplary embodiments, the first and second housing members 58, 60 may be formed of a plastic material, such as a polyvinylchloride (PVC), a acrylonitrile butadiene styrene (ABS), a polycarbonate (PC), or any other suitable plastic material. However, in other exemplary embodiments, the integrated housing 36 may additionally, or alternatively, be formed of any other suitable materials, such as a metal material.

Such a configuration may allow for a more compact and a space efficient mounting of a lighting assembly and electro-mechanical switch beneath a control surface, between a control valve and control knob. Specifically, such a configuration may allow for mounting of the lighting assembly 38 and electro-mechanical switch 40 in a single housing defining a height along the axial direction A less than a height along the axial direction A required to mount the lighting assembly 38 and the electro-mechanical switch 40 independently in separate housings. Accordingly, such a configuration may allow for a control assembly having a smaller overall footprint than previous similar control assemblies. Moreover, such a configuration may allow for an increased airflow through the control surface, i.e., through an opening through which a control rod of the control assembly extends, and to one or more heating elements/gas burners of the cooking appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance, comprising:
- a cooking surface including a heating element;
- a control surface;
- a control element positioned on the control surface and associated with the heating element;
- a control rod operable with the control element; and
- an integrated housing positioned below the control surface and aligned with the control element, the integrated housing enclosing
  - a lighting assembly for providing light to at least one of the control element or the control surface proximate to the control element, the lighting assembly including a first electro-mechanical switch operable with the control rod to control operation of the lighting assembly; and
  - a second electro-mechanical switch operably coupled to the control element through the control rod for igniting the heating element.

2. The cooking appliance of claim 1, wherein the heating element is a gas burner.

3. The cooking appliance of claim 2, wherein the control element is a control knob.

4. The cooking appliance of claim 3, wherein the cooking appliance further comprises a control valve for providing a fuel flow to the gas burner, and wherein the control rod extends completely through the integrated housing and to the control valve.

5. The cooking appliance of claim 4, wherein the second electro-mechanical switch is configured to provide a spark to the heating element in response to a position of the control rod.

6. The cooking appliance of claim 1, wherein the control surface is coplanar with the cooking surface.

7. The cooking appliance of claim 1, wherein the lighting assembly is a light-emitting diode ("LED") lighting assembly.

8. The cooking appliance of claim 1, wherein the integrated housing includes an electrical connection port to connect both the lighting assembly and the second electro-mechanical switch to power source.

9. The cooking appliance of claim 8, wherein the lighting assembly is mounted to an electrical connector within the integrated housing, the electrical connector connected to the electrical connection port.

10. The cooking appliance of claim 1, wherein the integrated housing is comprised of a first housing member and a second housing member, and wherein the first and second housing members are releasably attached to one another.

11. The cooking appliance of claim 10, wherein the first and second housing members are releasably attached to one another through a plurality of clips.

12. The cooking appliance of claim 1, wherein the integrated housing defines an enclosed volume, and wherein the lighting assembly and second electro-mechanical switch are positioned within the enclosed volume.

13. The cooking appliance of claim 12, wherein the lighting assembly is positioned at least partially above the second electro-mechanical switch within the enclosed volume of the housing.

14. An integrated housing for a cooking appliance including a control rod operable with a control element, the integrated housing aligned with the control element and comprising:

a first housing member; and a second housing member, the first and second housing member attached to one another and defining an enclosed area, the enclosed area housing a lighting assembly for providing light to at least one of the control element or a control surface of the cooking appliance proximate to the control element of the cooking appliance, the lighting assembly including a first electro-mechanical switch operable with the control rod to control operation of the lighting assembly, a second an electro-mechanical switch for operable connection to the control element of the cooking appliance for igniting the heating element.

15. The integrated housing of claim 14, wherein the lighting assembly is a light-emitting diode ("LED") lighting assembly.

16. The integrated housing of claim 15, wherein the LED lighting assembly includes a plurality of LEDs configured for illuminating in a single color.

17. The integrated housing of claim 15, wherein the LED lighting assembly includes a plurality of LEDs configured for eliminating in a two or more colors.

18. The integrated housing of claim 14, wherein the first housing member defines a plurality of openings, and wherein the lighting assembly is positioned within the enclosed area of the first and second housing members such that the lighting assembly provides light through the plurality of openings when activated.

19. The integrated housing of claim 14, wherein the second electro-mechanical switch is configured to provide a spark to a heating element.

20. The integrated housing of claim 14, the integrated housing includes an electrical connection port to connect the lighting assembly and the second electro-mechanical switch to a power source.

* * * * *